US009574353B1

(12) United States Patent
Umosella

(10) Patent No.: US 9,574,353 B1
(45) Date of Patent: Feb. 21, 2017

(54) BALUSTERS, RAILING SYSTEMS, AND METHODS OF ASSEMBLING AND INSTALLING THE SAME

(71) Applicant: INTEX MILLWORKS SOLUTIONS, LLC, Millville, NJ (US)

(72) Inventor: Joseph F. Umosella, Hammonton, NJ (US)

(73) Assignee: INTEX MILLWORKS SOLUTIONS, LLC, Millville, NJ (US)

( * ) Notice: Subject to any disclaimer, the term of this patent is extended or adjusted under 35 U.S.C. 154(b) by 0 days.

(21) Appl. No.: 14/965,292

(22) Filed: Dec. 10, 2015

(51) Int. Cl.
*E04F 11/18* (2006.01)

(52) U.S. Cl.
CPC ..... *E04F 11/1836* (2013.01); *E04F 11/1817* (2013.01); *E04F 11/1842* (2013.01); *E04F 2011/1897* (2013.01)

(58) Field of Classification Search
CPC .. E04F 11/1842; E04F 11/181; E04F 11/1817; E04F 11/1819; E04F 11/1823; E04F 11/1831; E04F 11/1834; E04F 11/1846; E04F 11/025
USPC ..... 52/832, 741.2
See application file for complete search history.

(56) References Cited

U.S. PATENT DOCUMENTS 1,664,080 A * 3/1928 Mapson ..... E04F 11/1834 256/22
1,757,686 A * 5/1930 Rosenbaum ..... E04F 11/181 256/19
3,736,720 A * 6/1973 Larson ..... E04F 11/1842 256/22
4,035,978 A * 7/1977 Bajorek ..... E04F 11/1842 256/21
4,421,302 A * 12/1983 Grimm ..... E04F 11/1834 256/59
4,533,121 A * 8/1985 Basey ..... E04F 11/1834 256/59
5,056,283 A * 10/1991 Sapinski ..... E04F 11/1834 256/65.11
5,557,893 A * 9/1996 Bowls ..... E04F 11/1834 256/64
5,695,175 A * 12/1997 Hawkins ..... B25B 5/003 256/59
6,017,019 A * 1/2000 Erwin ..... E04F 11/1834 256/60
6,036,177 A * 3/2000 Kirkwood, Jr. ..... E04F 11/1842 256/24
6,158,697 A * 12/2000 Young ..... B61L 11/04 246/274
6,311,957 B1 * 11/2001 Driscoll ..... E04F 11/181 256/59
7,178,791 B1 * 2/2007 Gray, Jr. ..... E04F 11/1834 256/65.08
8,356,803 B2 * 1/2013 Truckner ..... E04F 11/1834 256/67
2006/0175592 A1 * 8/2006 DeRogatis ..... E04F 11/181 256/59
2009/0179183 A1 * 7/2009 Ferris ..... E04F 11/1834 256/67

(Continued)

*Primary Examiner* — Brent W Herring
(74) *Attorney, Agent, or Firm* — Stradley Ronon Stevens & Young LLP

(57) ABSTRACT

A baluster is provided. The baluster includes a body portion. A width of an end portion of the body portion is less than a width of a central portion of the body portion.

20 Claims, 8 Drawing Sheets

(56) References Cited

U.S. PATENT DOCUMENTS

| | | | | |
|---|---|---|---|---|
| 2009/0272957 | A1* | 11/2009 | Nelson | E04F 11/1834 256/65.01 |
| 2009/0278106 | A1* | 11/2009 | Truckner | E04F 11/1834 256/67 |
| 2010/0237309 | A1* | 9/2010 | Ferris | E04F 11/1817 256/65.01 |
| 2011/0073824 | A1* | 3/2011 | Lappin | E04F 11/1817 256/65.08 |
| 2012/0012802 | A1* | 1/2012 | Dotsey | E04F 11/1817 256/65.07 |
| 2013/0214228 | A1* | 8/2013 | Sneith | E04F 11/1812 256/65.07 |
| 2014/0246639 | A1* | 9/2014 | Lee | E04F 11/1846 256/65.1 |
| 2015/0021534 | A1* | 1/2015 | Molina | E04H 17/1439 256/65.12 |
| 2015/0102277 | A1* | 4/2015 | Milanowski | E04F 11/1842 256/65.02 |
| 2015/0115214 | A1* | 4/2015 | Schneider | E04F 11/1844 256/67 |
| 2016/0097215 | A1* | 4/2016 | Molina | E04H 17/1421 256/65.12 |

* cited by examiner

BALUSTERS, RAILING SYSTEMS, AND METHODS OF ASSEMBLING AND INSTALLING THE SAME

FIELD

The invention relates to balusters and railing systems, and more particularly, to improved balusters and railing systems for stair systems.

BACKGROUND

Manufacturing and installation of railing systems, for example, in connection with stair systems (e.g., outdoor stair systems such as deck stair systems, etc.) continues to be labor intensive and time consuming. Particular challenges exist in connection with the alignment and installation of balusters of the stair systems.

For example, it is desirable to have substantially uniform spacing between adjacent ones of the plurality of balusters in a railing system. Further, the interconnection between the plurality of balusters and the associated rail portions creates challenges, including issues related to the appearance of such interconnections (e.g., issues related to a desirable tight fit between each of the plurality of balusters and the associated rail portions).

Thus, it would be desirable to provide improved balusters, railing systems, and methods of installing the same.

SUMMARY

According to an exemplary embodiment of the invention, a baluster is provided. The baluster includes a body portion. A width of an end portion of the body portion is less than a width of a central portion of the body portion.

According to another exemplary embodiment of the invention, a railing system is provided. The railing system includes a bottom rail portion defining a plurality of bottom openings, and a top rail portion defining a plurality of top openings. The railing system also includes a plurality of balusters, each of the plurality of balusters extending between (a) a respective one of the plurality of bottom openings and (b) a corresponding one of the plurality of top openings. Each of the plurality of balusters includes a body portion, wherein a width of an end portion of the body portion configured to be inserted into one of the plurality of bottom openings is less than a width of a central portion of the body portion.

According to another exemplary embodiment of the invention, a method of installing a railing system is provided. The method includes the steps of: (a) providing a bottom rail portion defining a plurality of bottom openings; (b) engaging an end portion of each of a plurality of balusters in a corresponding one of the plurality of bottom openings; and (c) engaging a top rail portion with the plurality of balusters, step (c) including aligning each of a plurality of top openings defined by the top rail portion with another end portion of a respective one of the plurality of balusters. Each of the plurality of balusters includes a body portion. A width of an end portion of the body portion, configured to be inserted into one of the plurality of bottom openings, is less than a width of a central portion of the body portion.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION

The invention is described, in part, in connection with a width of an end portion of a body portion of a baluster. It is understood that the term "width" shall be broadly construed, for example, and may refer to the width of the baluster in either direction (e.g., a width front to back, a width side to side, etc.).

Figure 1A:
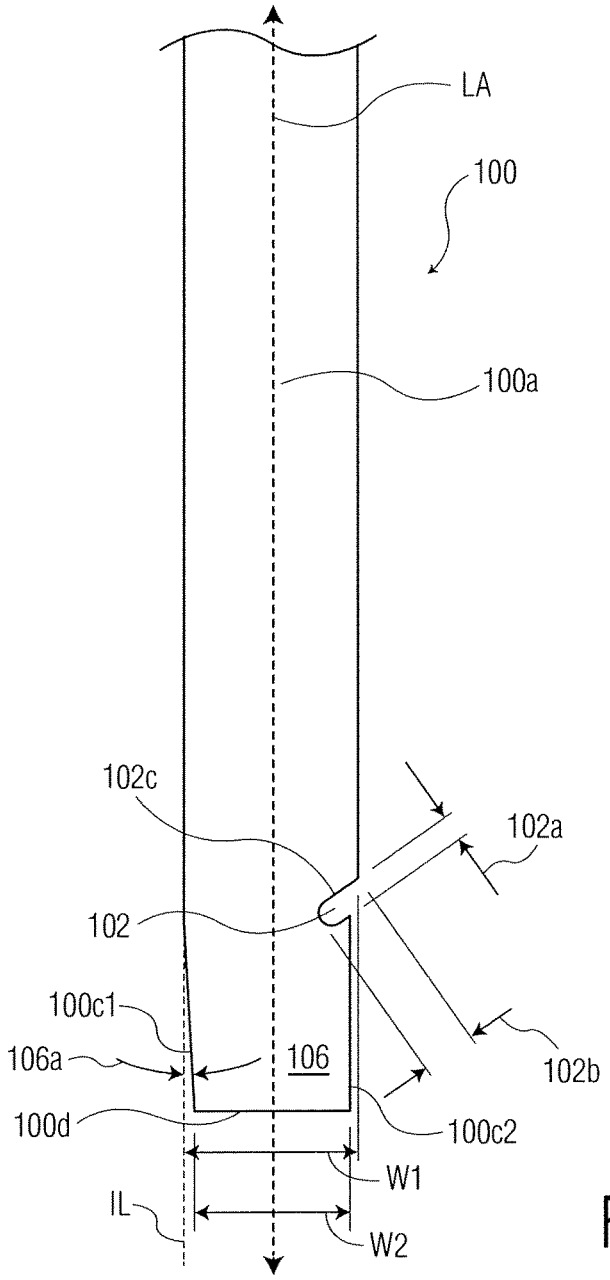
FIG. 1A is a side view of a lower portion of a baluster in accordance with an exemplary embodiment of the invention.

FIG. 1A illustrates a lower portion of a baluster 100 having a body portion 100*a* including a lower end portion 106. "LA" shown in FIG. 1A illustrates a longitudinal axis along which baluster 100 extends. Balusters according to the invention may be solid structures, hollow structures, etc. Exemplary materials used to form the balusters include plastic materials (e.g., PVC—polyvinyl chloride, polyurethane, polypropylene, etc.), composite materials (e.g., wood composite, fiberglass composite, a metal composite), amongst others.

A portion of the material at lower end portion 106 has been removed (e.g., by machining or other techniques) such that a width of lower end portion 106 of body portion 100*a* is less than a width of a central portion of the body portion 100*a* (e.g., see central portion 100*b* of the body portion of baluster 100 illustrated in FIG. 3). In FIG. 1A, most of body portion 100*a* (including the central portion, not shown in FIG. 1, but see FIG. 3) has a width W1; however, because material has been removed from each side of lower end portion 106, lower end portion 106 has a reduced width. At the bottom edge of baluster 100, lower end portion 106 has a width W2. In the example shown in FIG. 1A, side wall 100*c*1 of lower end portion 106 is tapered such that the width of end portion 106 varies along its length between width W1 and width W2 (where width W2 is the width at the bottom edge of the lower end portion, where side walls 100*c*1, 100*c*2 meet bottom surface 100*d*). An exemplary range by which the width changes from width W1 to width W2 is 5-15%. For example, if the width of portion portion W1 is 1.25 inches, then the width W2 (i.e., the width at the bottom edge of baluster 100) may be in a range between 1.0625 inches and 1.1875 inches (with a substantially equal amount of material removed from each side of lower end portion 106).

It is noteworthy in FIG. 1A that sidewall 100*c*2 is not tapered like side wall 100*c*1. That is, the width of the material of sidewall 100*c*2 has already been reduced in connection with the formation of indentation 102. Thus, the portion of lower end portion 106 below indentation 102 (i.e., corresponding to sidewall 102*c*2) already has the desired dimension. Of course, it is understood that side wall 102*c*2 could be tapered (e.g., in a manner similar to sidewall 100*c*1).

Figure 1B:
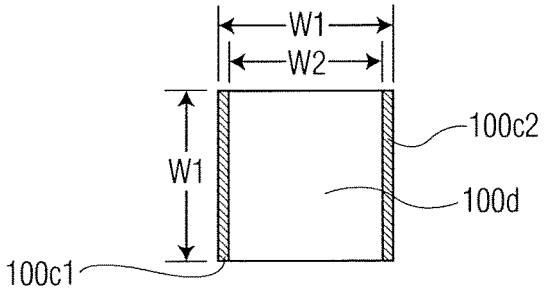
FIG. 1B is an end view of the baluster of FIG. 1A, looking at a bottom surface of the baluster, in accordance with an exemplary embodiment of the invention.

FIG. 1B is a bottom view of baluster 100 showing bottom surface 100*d*. In the example shown in FIG. 1B, baluster 100 has a substantially square cross section (except at lower end portion 106, where the width varies along the direction of tapered side wall 100*c*1) with a width W1 in both dimensions. FIG. 1B illustrates tapered side wall 100*c*1, and side wall 100*c*2 below indentation 102, as "hatched" areas.

FIG. 1A also illustrates an angle 106*a* which is the angle between (1) the tapered side of lower end portion 106 and (2) an imaginary line "IL" extending from the side of body portion 100*a* (i.e., from the central portion of body portion 100*a*). An exemplary range for angle 106*a* is 2-7 degrees. Although only side wall 102*c*1 follows angle 106*a*, it is understood that opposing side wall 102*c*2 could follow a similar angle, within a similar exemplary rang (e.g., 2-7 degrees).

FIG. 1A also illustrates indentation 102 (having a width 102*a*, and a depth 102*b*) defined by a side of body portion 100*a* adjacent lower end portion 106. Indentation 102 extends along a downward (i.e., non-perpendicular) angle with respect to longitudinal axis "LA" of baluster 100.

Figure 2A:
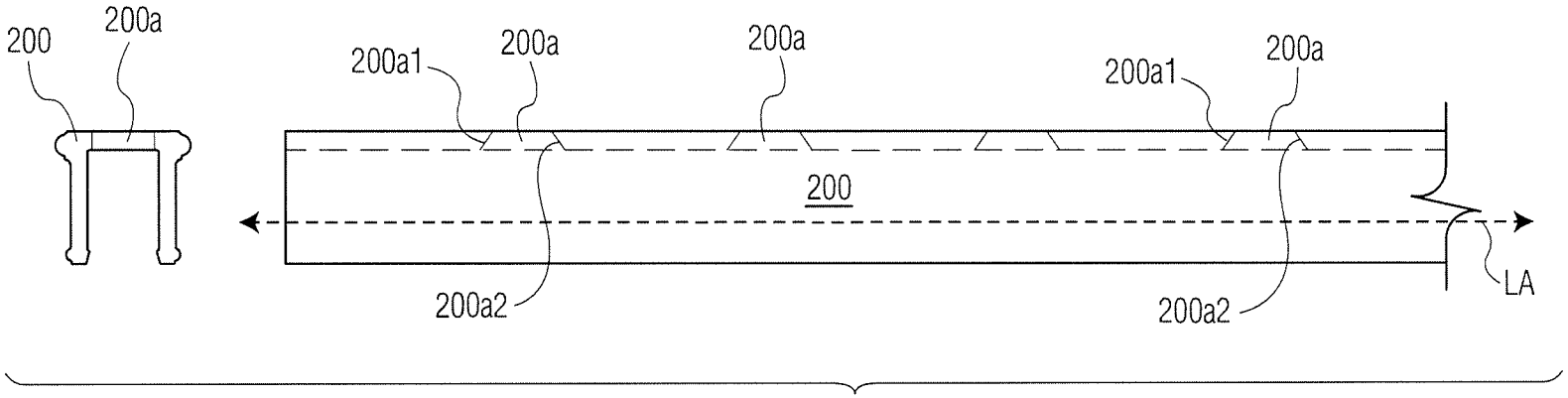
FIG. 2A is a hidden side view (illustrating internal and external features), and an end view, of a bottom rail portion of a railing system in accordance with an exemplary embodiment of the invention.

FIG. 2A is a side view (and an end view on the left) of a bottom rail portion 200 of a railing system. Bottom rail portion 200 defines a plurality of bottom openings 200*a*. Each of the bottom openings are defined by a pair of side walls 200*a*1, 200*a*2. Each of side walls 200*a*1, 200*a*2 extends along an angle that is non-perpendicular with respect to a longitudinal axis ("LA") of bottom rail portion 200.

Figure 2B:
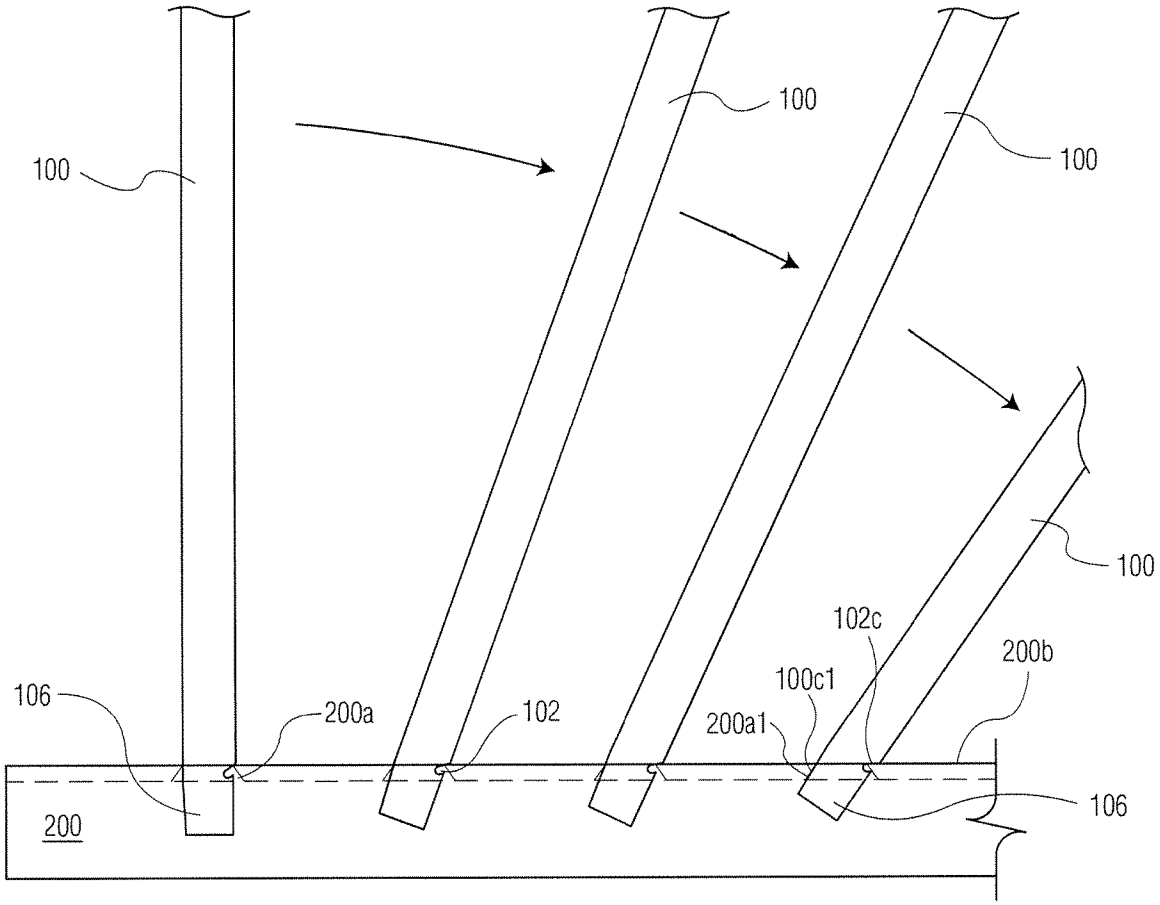
FIG. 2B is a side sectional view of the bottom rail portion of FIG. 2A, along with a plurality of balusters, in accordance with an exemplary embodiment of the invention.

FIG. 2B illustrates a portion of bottom rail portion 200 including a plurality of balusters 100 with respective lower end portions 106 inserted into respective ones of bottom openings 200*a*. From left to right, FIG. 2B illustrates the plurality of balusters in various states of rotation with respect to bottom rail portion 200. The left most baluster 100 is shown after insertion of lower end portion 106 into opening 200*a*. The right most baluster 100 is shown having been rotated such that the side wall 100*c*1 of lower end portion 106 rests against side wall 200*a*1 of the bottom opening 200*a*, and top surface 102*c* (see FIG. 1) of indentation 102 rests against an upper surface 200*b* of bottom rail portion 200. Thus, a clean and tight fit (and appearance) is provided between each of the balusters 100 and the corresponding opening of bottom rail portion 200. Using balusters (and railing systems) according to the invention, such a clean and tight fit may be provided for railing systems having balusters configured at a wide range of angles (e.g., 18-42 degrees with respect to a floor or other flat surface), for example, to accommodate varying stair systems.

Figure 3B:
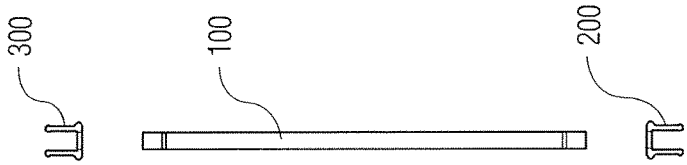
FIG. 3B is a sectional view of FIG. 3A taken along line A-A.
Figure 3A:
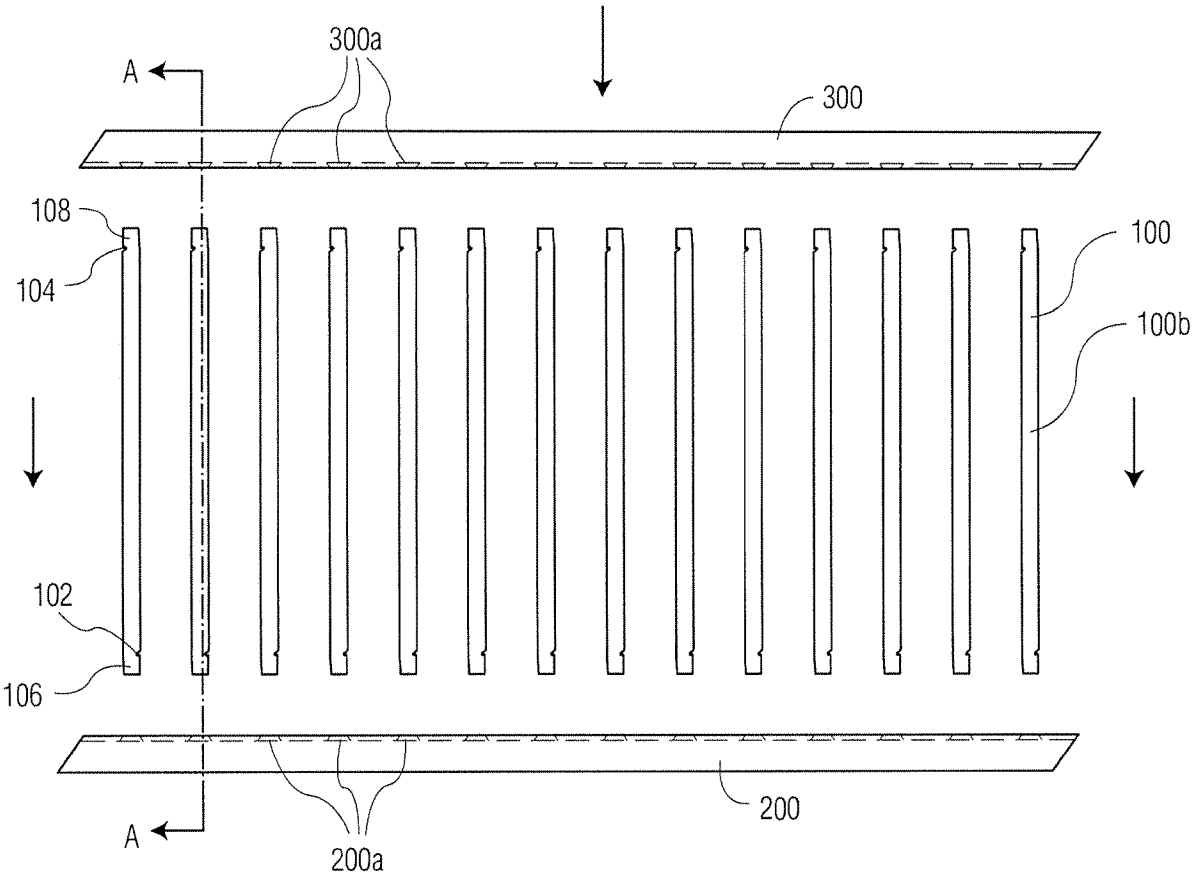
FIG. 3A is a side sectional view of a bottom rail portion, a plurality of balusters, and a top rail portion, of a railing system in an exploded configuration in accordance with an exemplary embodiment of the invention.

While FIGS. 1 and 2B illustrate lower end portion 106 of a baluster 100, and a bottom rail portion 200—according to certain embodiments of the invention the same aspects inventive aspects apply to an upper end portion 108 of balusters 100 and a top rail portion 300. FIGS. 3A-3B illustrate such a configuration. Specifically, FIG. 3A illustrates top rail portion 300 (including openings 300*a* defined by angled side walls) in addition to bottom rail portion 200. Each of balusters 100 shown in FIG. 3A includes a lower end portion 106 (defining indentation 102) and an upper end portion 108 (including indentation 104). One or both of the side walls of upper end portion 108 may be tapered in a manner similar to tapered side wall 100*c*1 of lower end portion 106 shown and described in connection with FIG. 1A, with a width W2 at the upper edge of upper end portion 108. Indentation 104 defined by upper end portion 108 is a mirror image of indentation 102 defined by lower end portion 106. As shown in FIG. 3A, indentation 104 is defined on an opposite side of baluster 100 as compared to indentation 102. As compared to the downward extending angle along which indentation 102 extends (see FIG. 1, where indentation 102 extends along a downward angle), indentation 104 extends along an upward angle. As shown in FIG. 3A, the upper side wall above indentation 104 is not tapered, but the opposite side wall is tapered, similar to the arrangement of lower end portion 106 (i.e., where side wall 100*c*1 without an indentation is tapered, but where side wall 100*c*2 with indentation 102 is not tapered).

As shown by the downward arrow on the right hand side of FIG. 3A, the lower end portion 106 of each of the balusters 100 is inserted into an opening 200*a* of bottom rail portion 200. Then, as shown by the downward arrow on the top of FIG. 3A, top rail portion 300 is lowered such that each upper end portion 108 of a baluster 100 is inserted into a corresponding opening 300*a*.

Figure 4B:
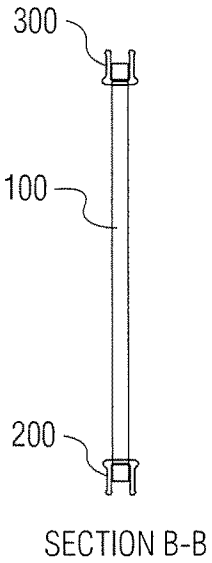
FIG. 4B is a sectional view of FIG. 4A taken along line B-B.
Figure 4A:
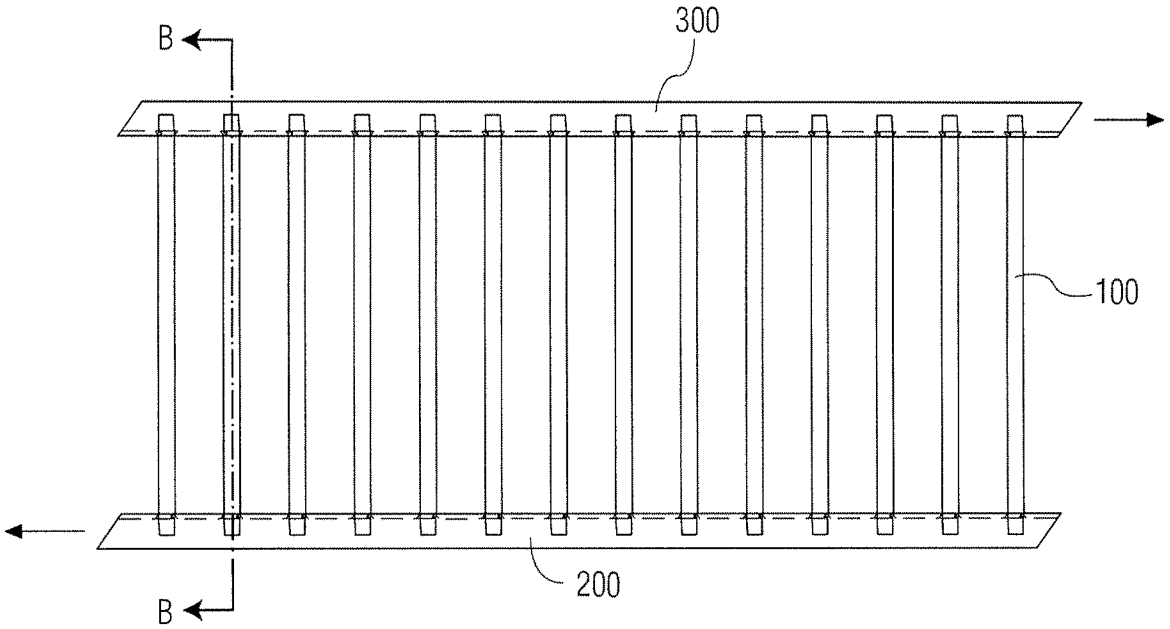
FIG. 4A is a side sectional view of the bottom rail portion, the plurality of balusters, and the top rail portion of FIG. 3A, in an interconnected configuration, in accordance with an exemplary embodiment of the invention.

FIG. 4A (and the sectional view B-B in FIG. 4B) illustrates the configuration after the assembly described above in connection with FIG. 3A. In this configuration (with each baluster 100 in a substantially perpendicular orientation with respect to the longitudinal axis of each of bottom rail portion 200 and top rail portion 300), the assembly shown in FIG. 4A is to be "racked" by moving top rail portion 300 with respect to bottom rail portion 200 such that each of the balusters 100 is oriented at a non-perpendicular angle with respect to a longitudinal axis of each of bottom rail portion 200 and top rail portion 300. This racking movement is illustrated by the arrow shown on the right side of FIG. 4A.

Figure 5B:
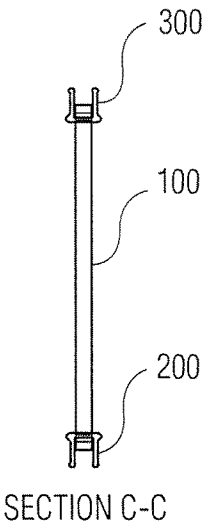
FIG. 5B is a sectional view of FIG. 5A taken along line C-C.
Figure 5A:
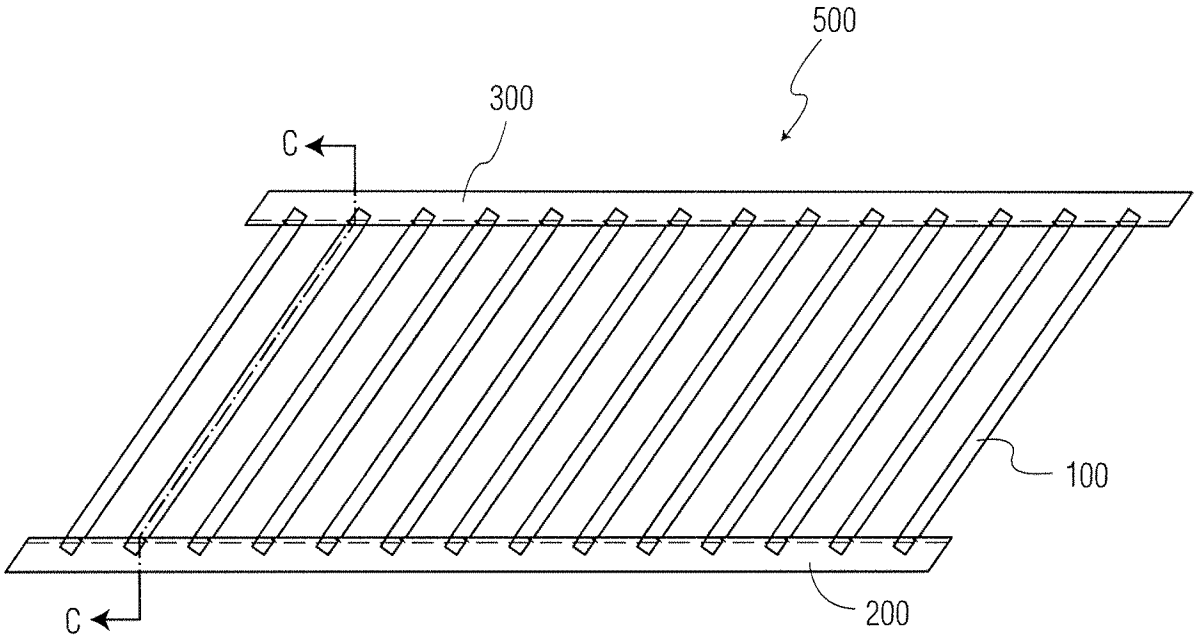
FIG. 5A is a side sectional view of the portions of the railing system of FIG. 4A in a racked configuration in accordance with an exemplary embodiment of the invention.

FIG. 5A (and the sectional view C-C of FIG. 5B) illustrates an assembly 500 including balusters 100, bottom rail portion 200, and top rail portion 300, after the racking movement described above.

Figure 6:
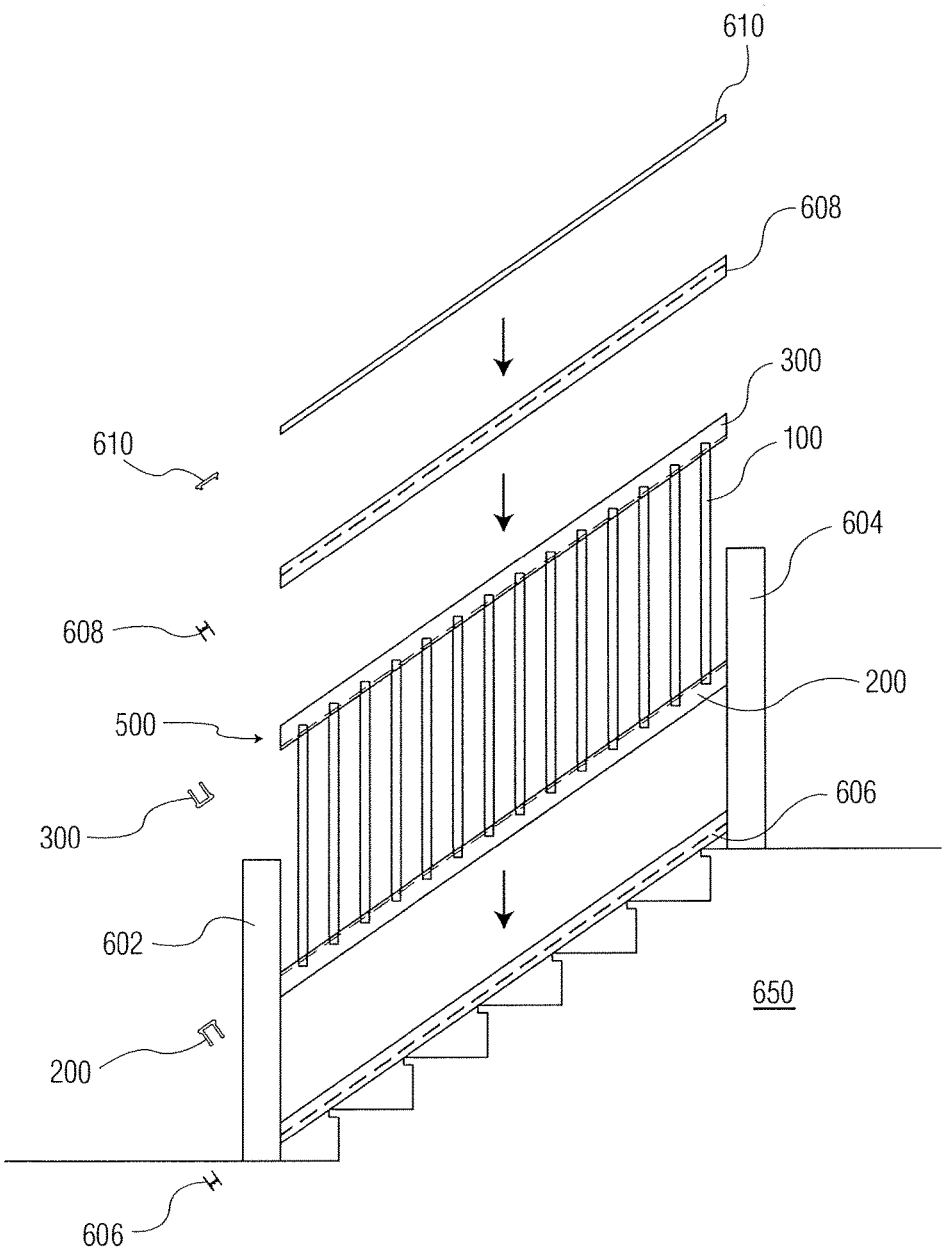
FIG. 6 is a side sectional view of various elements of a railing system in an exploded configuration in accordance with an exemplary embodiment of the invention.

FIG. 6 illustrates a side view (and an end view of each component on the left side of FIG. 6) of a railing system 600 installed in connection with a stair system 650. Railing system 600 includes posts 602, 604 (sometimes referred to as "newels") secured in position with respect to stair system 650. A bottom rail reinforcement member 606 (e.g., formed of aluminum) is secured to each post 602, 604, for example, using fasteners (e.g., bolts, screws, etc.). Then, assembly 500 is inserted between posts 602, 604 such that bottom rail portion 200 is engaged with (e.g., slides over) bottom rail reinforcement member 606. Then, a top rail reinforcement member 608 (e.g., formed of aluminum) is engaged with top rail portion 300 (e.g., slides within an aperture defined by top rail portion 300), and then top rail reinforcement member 608 is secured to each post 602, 604, for example, using fasteners (e.g., bolts, screws, etc.). Then, a top rail cap 610 is secured to top rail reinforcement member 608 (e.g., snapped into placed on top rail reinforcement member 608).

Figure 7:
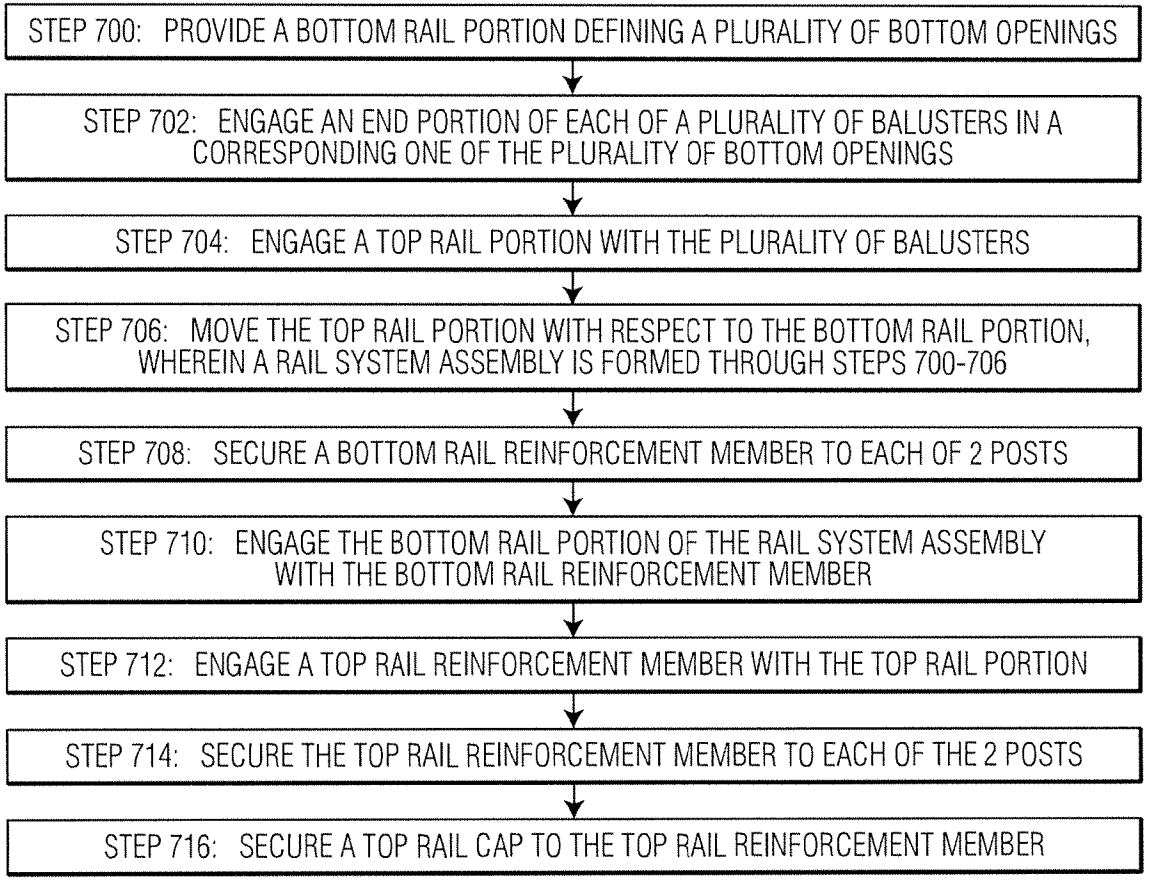
FIG. 7 is a method of installing a railing system in accordance with an exemplary embodiment of the invention.

FIG. 7 is a flow diagram in accordance with certain exemplary embodiments of the invention. As is understood by those skilled in the art, certain steps included in the flow diagram may be omitted; certain additional steps may be added; and the order of the steps may be altered from the order illustrated.

Referring specifically to the flow diagram in FIG. 7, a method of installing a railing system is provided. At step 700, a bottom rail portion is provided that defines a plurality of bottom openings (e.g., see bottom rail portion 200 in FIG. 2A defining bottom openings 200*a*). At step 702, an end portion of each of a plurality of balusters is engaged in a corresponding one of the plurality of bottom openings (e.g., see engagement of lower end portions 106 with respective bottom openings 200*a* between FIG. 3A and FIG. 4A). At step 704, a top rail portion is engaged with the plurality of balusters, wherein step 704 includes aligning each of a plurality of top openings defined by the top rail portion with an upper end portion of a respective one of the plurality of balusters (e.g., see engagement of upper end portions 108 with respective top openings 300*a* between FIG. 3A and FIG. 4A). At step 706, the top rail portion is moved with respect to the bottom rail portion after step 704 such that each of the plurality of balusters is oriented at a non-perpendicular angle with respect to a longitudinal axis of each of the bottom rail portion and the top rail portion (e.g., see relative movement between top rail portion 300 and bottom rail portion 200 in FIGS. 4A and 5A). Through Steps 700-706, a rail system assembly is formed (e.g., a rail system assembly 500 shown in FIG. 5A and FIG. 6). At step 708, a bottom rail reinforcement member is secured to each of a first post and a second post (e.g., see FIG. 6 illustrating bottom rail reinforcement member 606 secured to posts 602, 604). At step 710, the bottom rail portion is engaged with the bottom rail reinforcement member, for example, after Steps 700-708 (e.g., see engagement of bottom rail portion 200 of assembly 500 with bottom rail reinforcement member 606 in FIG. 6). At step 712, a top rail reinforcement member is engaged with the top rail portion (e.g., see top rail reinforcement member 608 to be engaged with top rail portion 300 in FIG. 6). At step 714, the top rail reinforcement member is secured to each of the 2 posts (e.g., top rail reinforcement member 608 shown in FIG. 6 is configured to be secured to posts 602, 604). At step 716, a top rail cap is secured to the top rail reinforcement member (e.g., see top rail cap 610 in FIG. 6 configured to be secured to top rail reinforcement member 608).

The invention has been described with respect to an end portion of a body portion of a baluster, where a width of an end portion is less than a width of other parts of the body portion (e.g., the central portion of the body portion). As provided above, the width of the end portion may be changed, for example, using machining or other techniques. For example, a baluster having a substantially square cross section may have its bottom end portion (and its top end portion) machined or otherwise changed to remove material, for example, such that one or more of the the side walls (e.g., side wall 100*c*1) of the end portion are tapered. The method used to adjust the width may be selected as desired. Example techniques include machining, sawing, grinding, amongst others.

Although the invention is illustrated and described herein largely with reference to balusters and railing systems for stair systems, it is not limited thereto. The inventive balusters and railing systems (and methods of assembling and/or installing the same) have application beyond stair systems.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A railing system comprising:

a bottom rail portion defining a plurality of bottom openings;

a top rail portion defining a plurality of top openings; and a plurality of balusters, each of the plurality of balusters extending between (a) a respective one of the plurality of bottom openings and (b) a corresponding one of the plurality of top openings, each of the plurality of balusters including a body portion, wherein a width of an end portion of the body portion configured to be inserted into one of the plurality of bottom openings is less than a width of a central portion of the body portion, wherein a side of the body portion defines a slot adjacent the end portion, the slot extending along a non-perpendicular angle with respect to a longitudinal axis of the baluster, wherein an interior surface defining a portion of the slot rests against a surface of the bottom rail portion after installation of the railing system.

2. The railing system of claim 1 wherein each of the plurality of balusters is formed from at least one of a plastic material and a composite material.

3. The railing system of claim 1 wherein a width of another end portion of the body portion is less than the width of a central portion of the body portion.

4. The railing system of claim 1 wherein a side wall of the end portion is tapered such that the width of the end portion varies along a length of the end portion.

5. The railing system of claim 1 wherein the railing system is a stair railing system, and wherein during installation of the stair railing system each of the plurality of balusters is oriented at a non-perpendicular angle with respect to a longitudinal axis of each of the bottom rail portion and the top rail portion.

6. The railing system of claim 1 wherein the width of the end portion is 5-15% less than the width of the central portion.

7. The railing system of claim 1 wherein a width of another end portion of the body portion is less than a width of a central portion of the body portion, and another side of the body portion defines another slot adjacent the another end portion.

8. The railing system of claim 1 wherein each of the plurality of bottom openings are defined by a pair of side walls, each of the side walls extending along an angle that is non-perpendicular with respect to a longitudinal axis of the bottom rail portion.

9. The railing system of claim 1 wherein the railing system is a stair railing system.

10. A method of installing a railing system, the method comprising the steps of:

(a) providing a bottom rail portion defining a plurality of bottom openings;

(b) engaging an end portion of each of a plurality of balusters in a corresponding one of the plurality of bottom openings; and (c) engaging a top rail portion with the plurality of balusters, step (c) including aligning each of a plurality of top openings defined by the top rail portion with another end portion of a respective one of the plurality of balusters, wherein a width of the end portion of each of the plurality of balusters is less than a width of a central portion of each of the plurality of balusters, wherein a side of each of the plurality of balusters defines a slot adjacent the end portion, the slot extending along a non-perpendicular angle with respect to a longitudinal axis of the baluster, wherein an interior surface defining a portion of the slot rests against a surface of the bottom rail portion after installation of the railing system.

11. The method of claim 10 further comprising the step of (d) moving the top rail portion with respect to the bottom rail portion after step (c) such that each of the plurality of balusters is oriented at a non-perpendicular angle with respect to a longitudinal axis of each of the bottom rail portion and the top rail portion.

12. The method of claim 11 further comprising the step of securing a bottom rail reinforcement member to each of a first post and a second post, and then engaging the bottom rail portion with the bottom rail reinforcement member after steps (a), (b), (c), and (d).

13. The method of claim 12 further comprising the step of engaging a top rail reinforcement member with the top rail portion, and then securing the top rail reinforcement member to each of the first post and the second post.

14. The method of claim 10 wherein each of the plurality of balusters is formed from at least one of a plastic material and a composite material.

15. The method of claim 10 wherein a width of the another end portion of each of the plurality of balusters is less than a width of the central portion.

16. The method of claim 10 wherein a side wall of the end portion is tapered such that the width of the end portion varies along a length of the end portion.

17. The method of claim 10 wherein the railing system is a stair railing system, and wherein during installation of the stair railing system each of the plurality of balusters is oriented at a non-perpendicular angle with respect to a longitudinal axis of each of the bottom rail portion and the top rail portion.

18. The method of claim 10 wherein the width of the end portion is 5-15% less than the width of the central portion.

19. The method of claim 10 wherein the railing system is a stair railing system.

20. The method of claim 10 wherein each of the plurality of bottom openings are defined by a pair of side walls, each of the side walls extending along an angle that is non-perpendicular with respect to a longitudinal axis of the bottom rail portion.

* * * * *